United States Patent [19]

Coppock

[11] 4,429,877

[45] Feb. 7, 1984

[54] GAME OF CHANCE TO BE PLAYED IN CONJUNCTION WITH A BASEBALL GAME

[76] Inventor: C. Wallace Coppock, 920 Ely Blvd., South, Petaluma, Calif. 94952

[21] Appl. No.: 383,739

[22] Filed: Jun. 1, 1982

[51] Int. Cl.[3] ..... A63F 9/00

[52] U.S. Cl. ..... 273/139; 283/102

[58] Field of Search ..... 273/139; 283/100–102

[56] References Cited

U.S. PATENT DOCUMENTS

| | | | |
|---|---|---|---|
| 3,055,117 | 9/1962 | Bernstein et al. | 283/102 X |
| 3,212,780 | 10/1965 | Jewell | 273/139 X |
| 3,826,499 | 7/1974 | Lenkoff | 273/139 X |
| 3,918,174 | 11/1975 | Miller et al. | 283/102 X |
| 4,034,987 | 7/1977 | Kelly | 273/139 X |

OTHER PUBLICATIONS

Kellogg's Sports Game, 1/74.

*Primary Examiner*—Paul E. Shapiro

*Attorney, Agent, or Firm*—Melvin R. Stidham

[57] ABSTRACT

A game of chance to be played in conjunction with a game of baseball comprising a card with rows of spaces, each row representing an inning of a baseball game. All spaces are masked so that marks printed therein are not visible. The mask on a first space in a row is removed to reveal a "1", a "2" or a "3" indicating one of the three batters on one team certain to appear at bat in the inning represented. Each of a group of other spaces has a mark representing a way in which a batter may reach base safely. Only one of these spaces is unmasked to see if the batter in the baseball game indicated by the final space can match the performance indicated by the selected one of the group of second spaces.

9 Claims, 2 Drawing Figures

GAME OF CHANCE TO BE PLAYED IN CONJUNCTION WITH A BASEBALL GAME

BACKGROUND OF THE INVENTION

Baseball is considered by many to be "America's pastime", its favorite spectator sport. While this may be subject to challenge, there is no question that many, many people enjoy spending an afternoon or evening in attendance at a baseball game or even listening to one on radio or television. In most cases, the spectator or listener has a particular affinity for one of the teams, the "home" team for example, and this gives him a partisan interest in the outcome of the game, and even on an inning to inning basis. However, it often occurs that for some reason, such as a one-sided score in favor of the visiting team, spectator and listener interest in a game may lag, tempting the person to leave the premises of the baseball game or to switch stations in the event of a radio broadcast or telecast. It is important to seek to maintain spectator interest throughout the entire game in order to enhance player morale, not to mention the more commercial aspects of maintaining interest in television and broadcasting commercials and to support the sales at the concession stands at the stadium. It is, therefore, highly desirable to add a further dimension to enhance spectator interest without detracting from the baseball game itself.

OBJECTS OF THE INVENTION

It is an object of this invention to provide a game of chance which is played in conjunction with an actual baseball game without distracting the spectator or listener from the game itself.

It is a further object of this invention to provide a game of chance, the results of which are determined by play on the field, thus enhancing rather than detracting from spectator interest in the game itself.

Other objects and advantages of this invention will become apparent from the description to follow, particularly when viewed in conjunction with the accompanying drawing.

SUMMARY OF THE INVENTION

In carrying out this invention, I provide a card which is printed for use in conjunction with a particular baseball game to be played. The card is marked with nine rows of boxes, one row for each inning. Each box is masked to conceal a mark therein, which is indicative of some facet of the baseball game. A first box in each row contains a "1", a "2" or a "3" representing a particular one of the three batters on a team who are certain to bat in the inning represented. The mask is removed from this box to reveal the identity of the baseball player on whose performance the chance game player is relying. A next group of boxes contains one of several ways in which a batter may reach base safely. For example, this group of boxes may contain the marks "1", "2", "3", "H" and "W", representing a single, double, triple, home run or walk. These marks are, of course, placed in jumbled order so that the player has no way of knowing in which of the masked boxes a type of hit or walk will appear. The player then unmasks one of these boxes and his attention is reverted to the field to see if the particular player he was assigned matches the performance he has selected. Prizes may be awarded for a given number of winning combinations.

Other squares in the row of boxes may be unmasked to cover the hoped for performance of a player on the visiting team during their turn at bat. Again, the particular batter may be selected by unmasking a square, and the manner in which he is put out is uncovered by unmasking a selected one of another series of boxes. The card may even include a pair of team-selector boxes so that the card player can unmask and thereby commit himself to that one of the two teams he wishes to perform well at bat.

DESCRIPTION OF A PREFERRED EMBODIMENT

Figure 1:
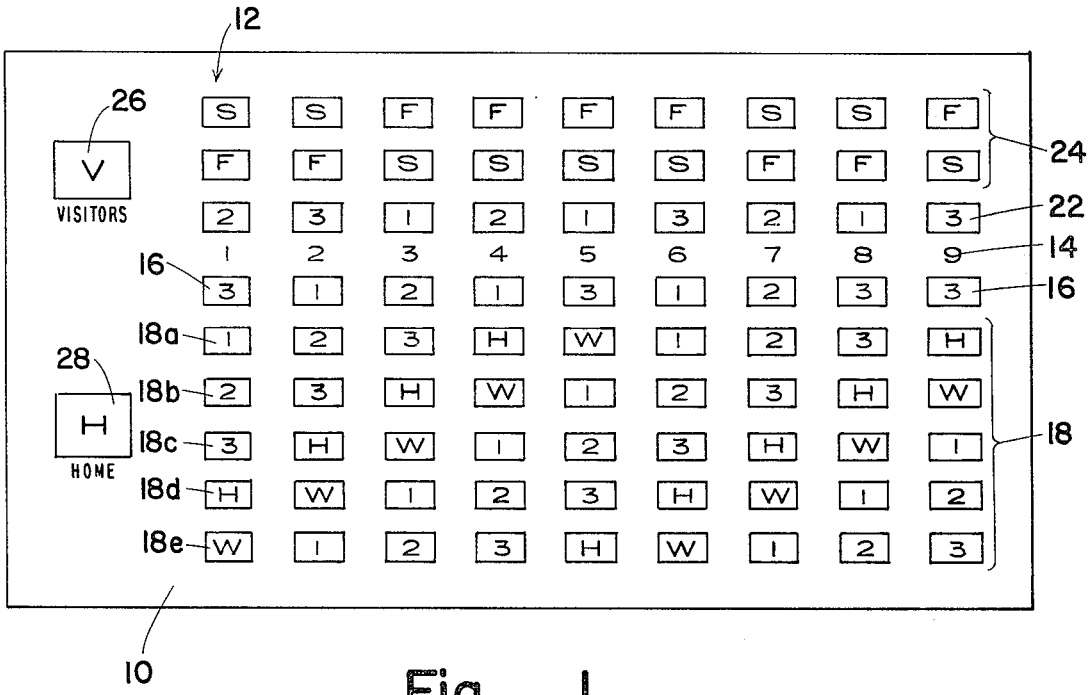
FIG. 1 is a top plan view of a game card showing rows of boxes with performance indicating marks therein.

Referring now to the drawing with greater particularity, the game card 10 of this invention is marked with a plurality of rows of spaces or boxes 12, there being preferably nine such rows, each marked at 14 to represent an inning of a baseball game to be played.

In each row, one box or space 16 is marked with a "1", a "2" or a "3" to indicate the first, second or third baseball player to appear at bat for the team favored by the card player, e.g. the home team, in the inning indicated by the number 14 of the row. Of course, there may be one of more than three numbers shown in the square 16, but with only three possibilities, each is bound to be represented by a batter in any given half-inning, and the card player is assured of a chance to match performances, as will be described.

Immediately below the player identification boxes 16 is a further group of spaces 18, with each one of the spaces 18*a*–18*e* being marked to indicate a way in which a batter may safely reach base. For example, the numbers "1", "2" and "3" may be used to indicate one, two and three base hits, the letter "H" used to indicate a home run and the letter "W" used to indicate a base on balls or walk.

In the alternative, there could be a single space 18*a*, offering a player no choice, and whatever manner of reaching space is depicted therein, that is the event that must be matched by the batter specified for the particular half inning.

All of the spaces 16 and 18*a* to 18*e* are covered with an opaque mask to obscure the space markings completely so that the particular number or letter appearing in a space is unknown until the mask 20 is removed. Moreover, the numbers and letters are jumbled and not repeated in sequence in different innings so that the selection of the batter's performance is purely by chance. The mask 20 may comprise a piece of opague tape, but preferably it comprises a coating of some form of ink that can be removed by scraping or wiping away. In this way, a choice, once made is irrevocable and a player is committed.

Figure 2:
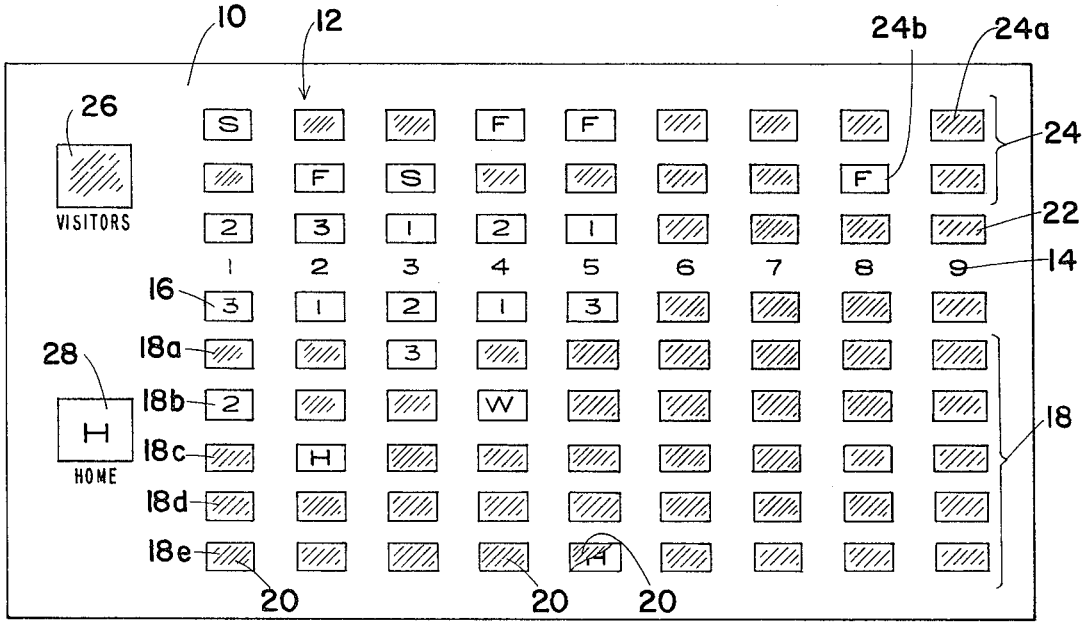
FIG. 2 is a top plan view of the card with the spaces masked and with some of the masks removed.

In playing the game in conjunction with a baseball game in play, the player removes the mask 20 from the space 16 at the beginning of each inning to determine which of the three players certain to appear at bat for his team during that inning is to have his performance measured against the card. Then one of the spaces 18*a* to 18*e* is uncovered to reveal the manner in which the batter selected is to reach base safely. For example, as shown in FIG. 2, removal of the mask 20 indicates that the third batter to appear in that inning is to hit a two base hit. If, on the field, this combination of circumstances actually occurs, the card player has a winning combination for that inning. Prizes may be awarded in accordance with the number of such winning combinations that are achieved during the course of the nine inning game. In this way, interest will be maintained throughout even the most one-sided of games.

Additional spaces 22 and 24 may be provided to measure against the performance of the opposing team when they are at bat. In the space 22 one of the three players to appear at bat is identified and each of the pair of spaces 24 is marked to represent the manner in which he is put out. For example, one of the squares 24*a* or 24*b* may be marked with a "S" to indicate a strike out and the other square marked with a "F" to indicate being put out by a fielder's play, i.e. catching a fly or pop-up or fielding a grounder and throwing out the batter.

Finally, there may even be provided a pair of team selection squares whereby the player may select that team he wishes to root for or encourage. These squares may be identified so that the player knows which team he has selected but, again, they are masked so that the selection becomes irrevocable. In the event that a player selects the visiting team, the roles indicated on the remainder of the card are reversed and the safe hitting performances appearing below the inning designators 14 are measured against the visiting team, while the negative performances appearing above the markings 14 are applied against the home team.

While this invention has been described in conjunction with a preferred embodiment thereof, it is obvious that modifications and changes therein may be made by those skilled in the art to which it pertains without departing from the spirit and scope of this invention, as defined by the claims appended hereto.

What I claim as invention is:

1. A game of chance to be played in conjunction with a baseball game comprising:

a game card having a row of spaces delineated thereon to represent possible activities in an inning of a baseball game in play;

one of three first marks in a first one of said spaces;

said one first mark representing one of the three players of one team certain to bat in a given inning;

at least one second space;

a second mark in each second space;

each of said second marks indicating one of several accomplishments of a baseball player during a turn at bat; and a removable mask covering each space in said row thereof to render a mark therein invisible.

2. The game of chance defined by claim 1 wherein:

each of said second marks indicate one of several ways in which a batter may reach base safely.

3. The game of chance defined by claim 2 including:

another space in said row thereof;

one of three third marks in said another space representing one of three players on the other team certain to bat in said given inning;

at least one further space in said row thereof; and a further mark in said further space representing a manner in which a batter may be put out.

4. The game of chance defined by claim 3 wherein:

there are two said further spaces and two said further marks, one said further mark representing a strike out and the other of said further mark representing a fielder's put out.

5. The game of chance defined by claim 1 wherein:

there is a group of second spaces; and each of said second marks indicate one of several ways in which a batter may reach base safely.

6. The game of chance defined by claim 5 wherein:

there are five second spaces;

four of said second marks indicate the four types of base hits a batter may make; and the fifth of said second marks represent a base on balls.

7. The game of chance defined by claim 1 including:

a pair of team choice spaces each with a mark therein representing one of the two teams in a baseball game.

8. The game of chance defined by claim 1 wherein:

there are a plurality of said rows of spaces.

9. The game of chance defined by claim 1 wherein:

there are nine of said rows of spaces.

* * * * *